US009091013B2

(12) United States Patent
Kim et al.

(10) Patent No.: US 9,091,013 B2
(45) Date of Patent: Jul. 28, 2015

(54) DRUM AND DRUM WASHING MACHINE HAVING THE SAME

(75) Inventors: Young Jae Kim, Incheon (KR); Kyu Chai Lee, Hwaseong (KR); Hong Yeol Lee, Yongin (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 619 days.

(21) Appl. No.: 12/926,163

(22) Filed: Oct. 28, 2010

(65) Prior Publication Data

US 2011/0126596 A1 Jun. 2, 2011

(30) Foreign Application Priority Data

Dec. 2, 2009 (KR) ..... 10-2009-0118433

(51) Int. Cl.

| | |
|---|---|
| ***B08B 3/12*** | (2006.01) |
| ***D06F 37/00*** | (2006.01) |
| ***D06F 37/04*** | (2006.01) |
| ***D06F 37/22*** | (2006.01) |

(52) U.S. Cl.

CPC ..... *D06F 37/04* (2013.01); *D06F 37/225* (2013.01); *Y10T 29/49963* (2015.01)

(58) Field of Classification Search

USPC ..... 68/3 R

See application file for complete search history.

(56) References Cited

U.S. PATENT DOCUMENTS

| | | | | |
|---|---|---|---|---|
| 5,855,127 | A | 1/1999 | Kohara et al. | |
| 6,442,782 | B1 | 9/2002 | Haar | |
| 2006/0254321 | A1 * | 11/2006 | Lim et al. | 68/12.01 |
| 2007/0277560 | A1 | 12/2007 | Kim et al. | |
| 2008/0314092 | A1 * | 12/2008 | Finke et al. | 68/5 C |

FOREIGN PATENT DOCUMENTS

| | | | |
|---|---|---|---|
| DE | 10 2009 021 327 | A1 | 11/2009 |
| EP | 0 787 847 | A2 | 8/1997 |
| JP | 2006-110065 | | 4/2006 |
| WO | 2010/107277 | A1 | 9/2010 |

OTHER PUBLICATIONS

Kuno et al., Apr. 2006, JP 2006-110065, English machine translation.*

European Search Report issued Jul. 24, 2014 in corresponding European Patent Application No. 10190583.4.

* cited by examiner

*Primary Examiner* — Jason Ko

(74) *Attorney, Agent, or Firm* — Staas & Halsey LLP

(57) ABSTRACT

The drum includes a drum body provided with at least one opening, and a balance ring passing through the at least one opening and detachably connected to the drum body.

8 Claims, 4 Drawing Sheets

DRUM AND DRUM WASHING MACHINE HAVING THE SAME

CROSS-REFERENCE TO RELATED APPLICATIONS

This application claims the benefit of Korean Patent Application No. 10-2009-0118433, filed on Dec. 2, 2009 in the Korean Intellectual Property Office, the disclosure of which is incorporated herein by reference.

BACKGROUND

1. Field

Embodiments relate to a drum in which a coupling structure of a balance ring is improved and a drum washing machine having the same.

2. Description of the Related Art

In general, a drum washing machine is an apparatus which washes laundry using a head difference of water while rotating a drum. The drum washing machine uses an electric motor as a main driving source, and performs wash, rinse, and spin cycles so as to separate contaminants from the laundry using detergent and water.

The drum washing machine rotates the drum at a high speed during the wash, rinse, and spin cycles. The drum is made of stainless steel, and thus deformation of the drum is prevented even if the drum is rotated at a high speed. Further, a balance ring is coupled with the drum. The balance ring allows the drum to be stably rotated at a high speed.

The drum washing machine may wash laundry using steam. The drum may be heated by steam, and thus a user may be burned due to contact with the heated drum, when the user takes the laundry out of the drum. Particularly, such a safety accident may happen at the front surface portion of the drum, through which the laundry is put into and taken out of the drum washing machine.

Therefore, the front surface portion of the drum may be made of synthetic resin so as to prevent safety accidents, such as burns. However, the front surface portion of the drum made of synthetic resin has a low strength, compared with stainless steel, and thus may be easily deformed during rotation at a high speed.

SUMMARY

Therefore, it is an aspect to provide a drum washing machine in which a coupling structure of a balance ring is improved so as to obtain rigidity and prevent safety accidents.

Additional aspects will be set forth in part in the description which follows and, in part, will be apparent from the description, or may be learned by practice of the invention.

In accordance with one aspect, in a drum washing machine having a drum rotatably supported by a tub, the drum includes a drum body provided with at least one opening, and a balance ring passing through the at least one opening and detachably connected to the drum body.

The drum body and the balance ring may be screw-connected to each other.

The drum body may be made of stainless steel, and the balance ring may be made of synthetic resin.

The drum body may include a curling part obtained by curling an end of the drum body in the outward direction of the drum body along the circumference of the drum body, and the balance ring may include an upper support part fitted into the drum body and seated on the curling part.

The drum body may include a neck part obtained by bending a portion of the drum body separated from an end of the drum body in the inward direction of the drum body along the circumference of the drum body, and the balance ring may include a lower support part fitted into the drum body and seated on the neck part.

The drum body may include an even part facing the balance ring, and the even part may be formed in an even plane in the axial direction of the drum body.

The drum body may be formed in a cylindrical shape, and the balance ring may be formed in a ring shape.

The balance ring may include a balance rib forming a laundry inlet, through which laundry is put into the drum.

In accordance with a further aspect, a drum rotatably supported by a tub includes a drum body provided with at least one opening, and a balance ring passing through the at least one opening and detachably connected to the drum body.

The drum body and the balance ring may be screw-connected to each other. The drum body may be made of stainless steel, and the balance ring may be made of synthetic resin.

The drum body may include a curling part obtained by curling an end of the drum body in the outward direction of the drum body along the circumference of the drum body, and a neck part obtained by bending a portion of the drum body separated from the curling part in the inward direction of the drum body along the circumference of the drum body, and the balance ring may include an upper support part fitted into the drum body and seated on the curling part, and a lower support part fitted into the drum body and seated on the neck part.

The drum body may further include an even part provided between the curling part and the neck part, and the even part may be formed in an even plane in the axial direction of the drum body.

In accordance with another aspect, a method of manufacturing a drum includes forming a drum body made of stainless steel in a cylindrical shape, forming a balance ring made of synthetic resin in a ring shape, and screw-connecting the drum body and the balance ring so as to detachably connect the balance ring to the drum body.

A curling part on which at least a part of the balance ring is seated may be formed on the drum body.

A neck part on which at least a part of the balance ring is seated may be formed on the drum body.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
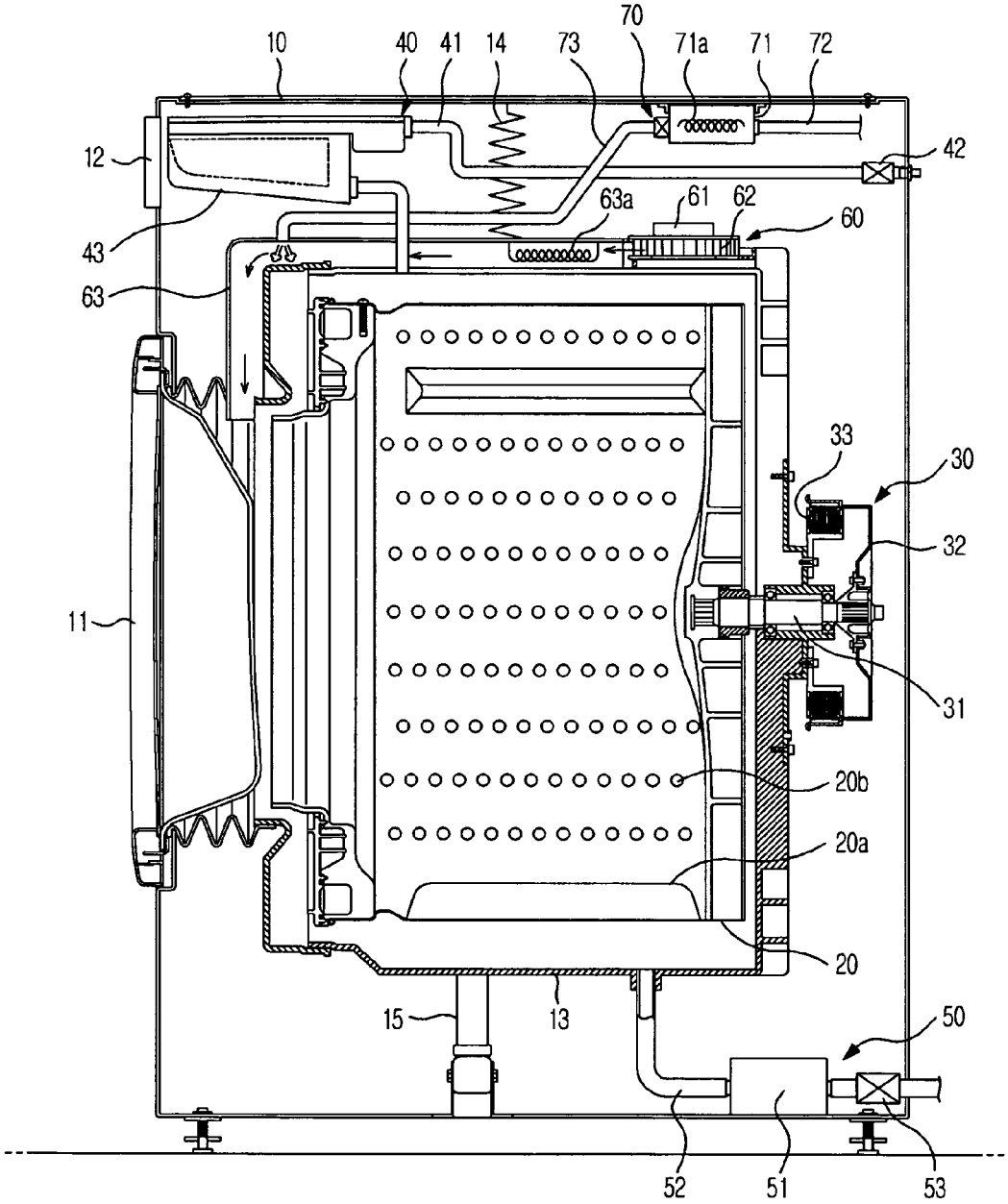
FIG. 1 is a longitudinal-sectional view of a drum washing machine in accordance with an embodiment.

Reference will now be made in detail to the embodiments, examples of which are illustrated in the accompanying drawings, wherein like reference numerals refer to the like elements throughout. The embodiments are described below to explain the present invention by referring to the figures.

FIG. 1 is a longitudinal-sectional view of a drum washing machine in accordance with an embodiment.

As shown in FIG. 1, the drum washing machine in accordance with the embodiment includes a cabinet 10 forming the external appearance of the washing machine, a door 11 hingedly installed on the cabinet 10, and a control panel 12 installed on the cabinet 10 to control the washing machine.

The door 11 is hingedly installed at a central portion of the front surface of the cabinet 10. A user puts laundry into the drum 20 or takes the laundry out of the drum 20 by opening the door 11.

The control panel 12 is installed at an upper portion of the front surface of the cabinet 10. The control panel 12 is configured to control a wash, rinse, or spin cycle. Further, the control panel 12 displays data regarding washing, such as a washing time or a washing course, such that the user can recognize a washing state of the washing machine.

The drum washing machine further includes a tub 13 installed within the cabinet 10, a drum 20 rotatably provided within the tub 13, and a driving device 30 to drive the drum 20.

The tub 13 is elastically supported by the cabinet 10. The tub 13 is supported by the cabinet 10 using an elastic member 14 and a damping member 15. The elastic member 14 and the damping member 15 reduce transmission of vibration and impact of the tub 13 to the cabinet 10. Here, the elastic member 14 may include a spring, and the damping member 15 may include an oil damper.

The tub 13 stores wash water. The drum washing machine stores wash water in the tub 13 through a water supply device 40. Further, the drum washing machine discharges the wash water stored in the tub 13 to the outside of the drum washing machine through a drain device 50.

The water supply device 40 includes a water supply channel 41, and a water supply valve 42 to open and close the water supply channel 41. When the water supply valve 42 is operated to open the water supply channel 41, wash water is supplied from an external water source to the tub 13 through the water supply channel 41. Here, a detergent box 43 is installed on the water supply channel 41, and the wash water flowing along the water supply channel 41 is mixed with a detergent stored in the detergent box 43 and then is supplied to the tub 13.

The drain device 50 includes a drain pump 51, a drain channel 52, and a drain valve 53. When the drain channel 52 is opened by the drain valve 53 and the drain pump 51 is operated, the wash water stored in the tub 13 is discharged to the outside of the drum washing machine through the drain channel 52.

The drum 20 is rotatably supported by the tub 13. The drum 20 supported by the tub 13 may be alternately rotated in the clockwise direction or in the counterclockwise direction and be rotated at a high speed.

The drum 20 includes lifters 20*a* to lift and then drop laundry, and through holes 20*b* to allow the wash water to pass through the drum 20. As the drum 20 is rotated in the clockwise direction or in the counterclockwise direction during the wash cycle, the lifters 20*a* lift and then drop the laundry so as to remove contaminants from the laundry. Further, the wash water stored in the tub 13 is introduced into the drum 20 via the through holes 20*b*, and the wash water introduced into the drum 20 is lifted and then dropped by the lifters 20*a* together with the laundry, thereby removing the contaminants from the laundry.

The driving device 30 includes a rotary shaft 31, a rotor 32, and a stator 33. The rotary shaft 31 is connected to the rotor 32, and is rotated according to rotation of the rotor 32 by interaction between the rotor 32 and the stator 33. Further, the rotary shaft 31 passes through the tub 13 and is connected to the drum 20, and thus transmits rotary force to the drum 20.

The drum washing machine further includes a hot air supply device 60 to supply hot air to the drum 20, and a steam supply device 70 to supply steam to the drum 20.

The hot air supply device 60 is installed on the upper surface of the tub 13, and supplies hot air into the drum 20 so as to rapidly dry laundry in the drum 20.

The hot air supply device 60 includes a motor 61, a fan 62 rotated by the motor 61, a drying duct 63 to guide air supplied by rotary force of the fan 62, and a heater 63*a* to heat the air guided by the drying duct 63. Hot air heated by the heater 63*a* is guided to an inlet of the tub 13 by the drying duct 63, and is supplied to the inside of the drum 20.

The steam supply device 70 is installed above the tub 13, and supplies steam so as to sterilize and disinfect the laundry and prevent the laundry from wrinkling.

The steam supply device 70 includes a housing 71 provided with a heater 71*a* installed therein, a water supply pipe 72 to supply water to the housing 71, and a steam supply pipe 73 connecting the housing 71 and the drying duct 63. When water is supplied to the inside of the housing 71 through the water supply pipe 72, the heater 71*a* heats water supplied to the inside of the housing 71 to convert water into steam, and the steam supply pipe 73 supplies the steam generated from the housing 71 to the drying duct 63. The drying duct 63 supplies the steam, supplied from the steam supply device 70, together with the hot air supplied from the hot air supply device 60 to the inside of the drum 20.

Figure 2:
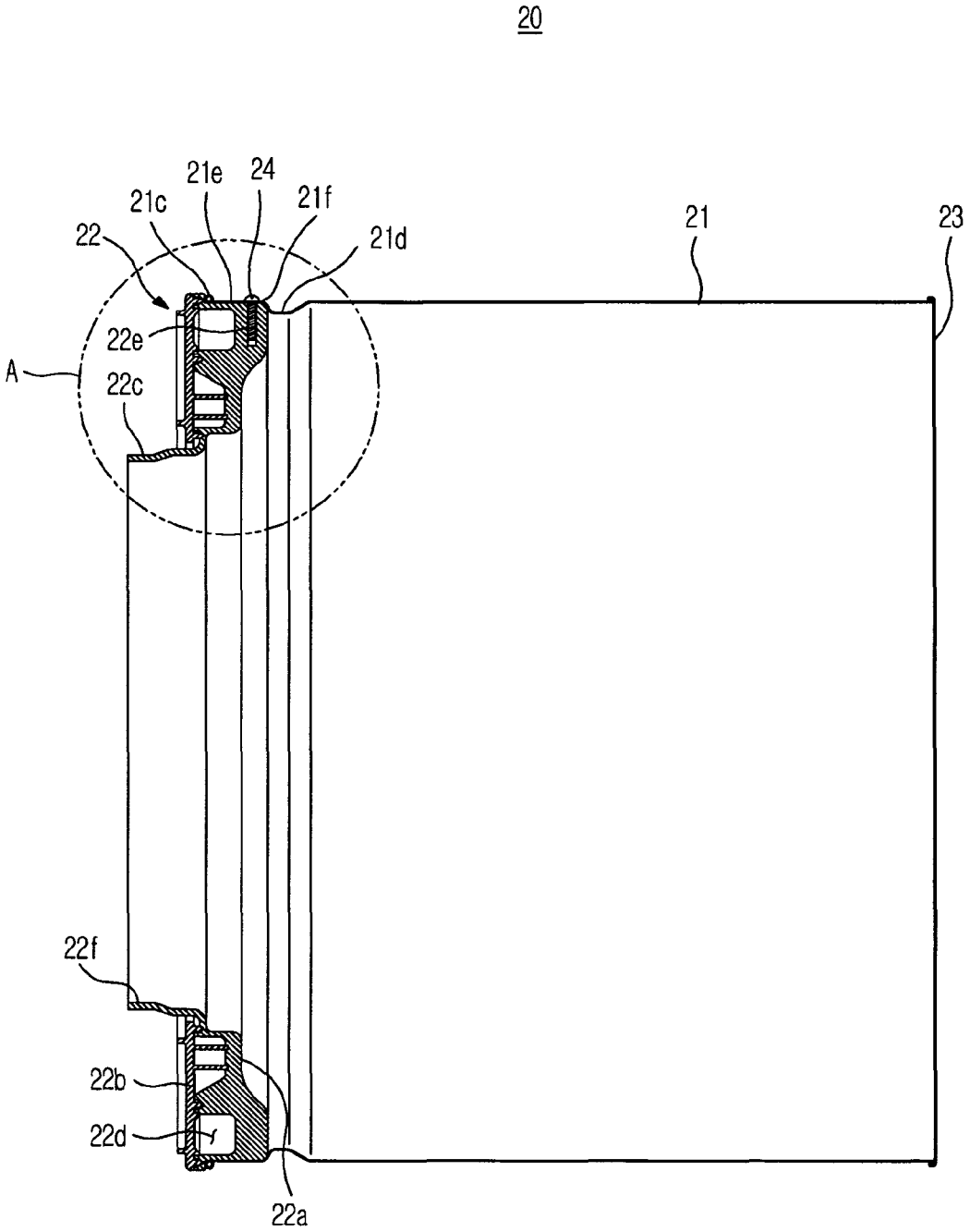
FIG. 2 is a view illustrating a connection state of a drum to the drum washing machine in accordance with the embodiment.
Figure 3:
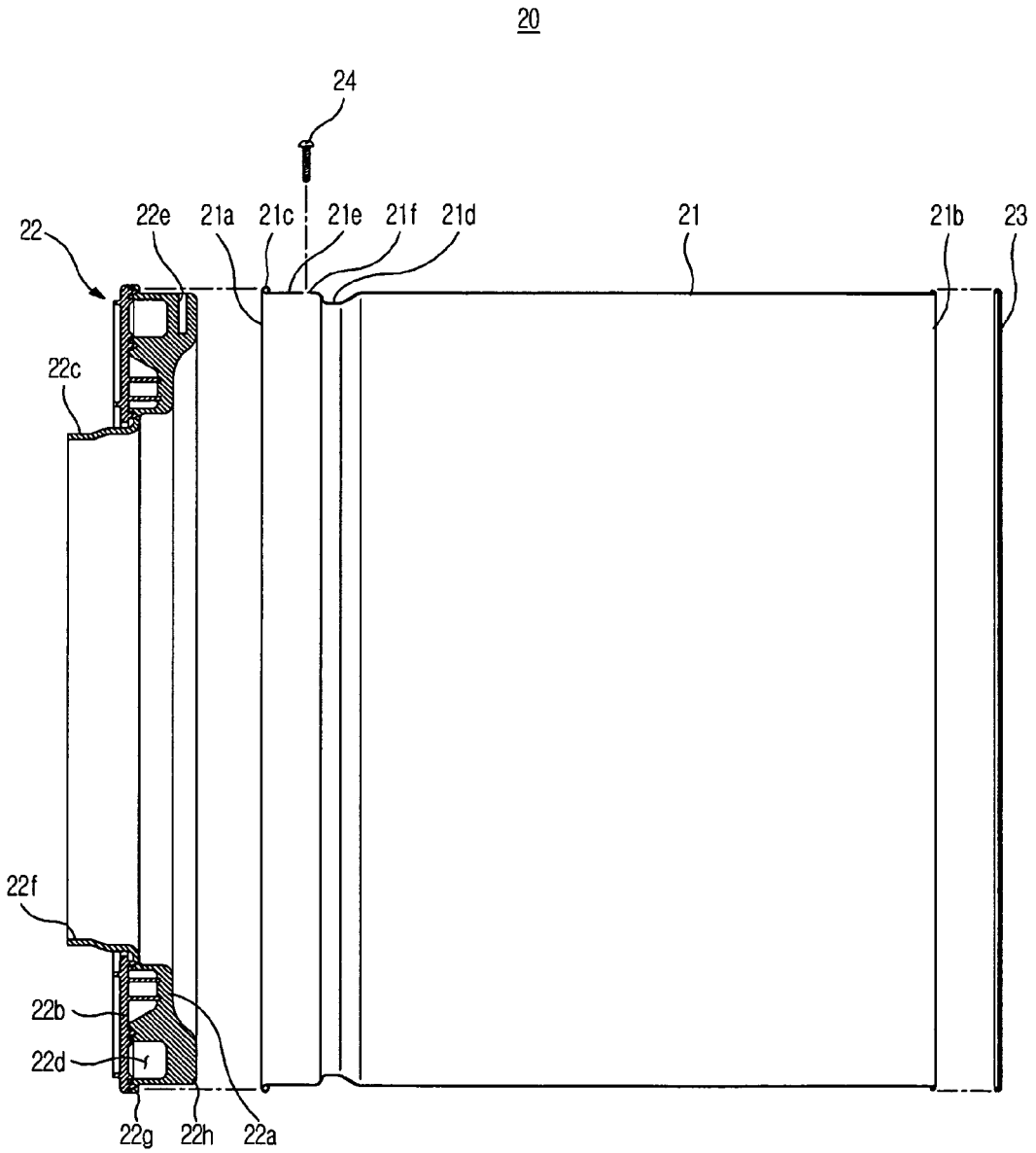
FIG. 3 is a view illustrating a disconnection state of the drum from the drum washing machine in accordance with the embodiment.
Figure 4:
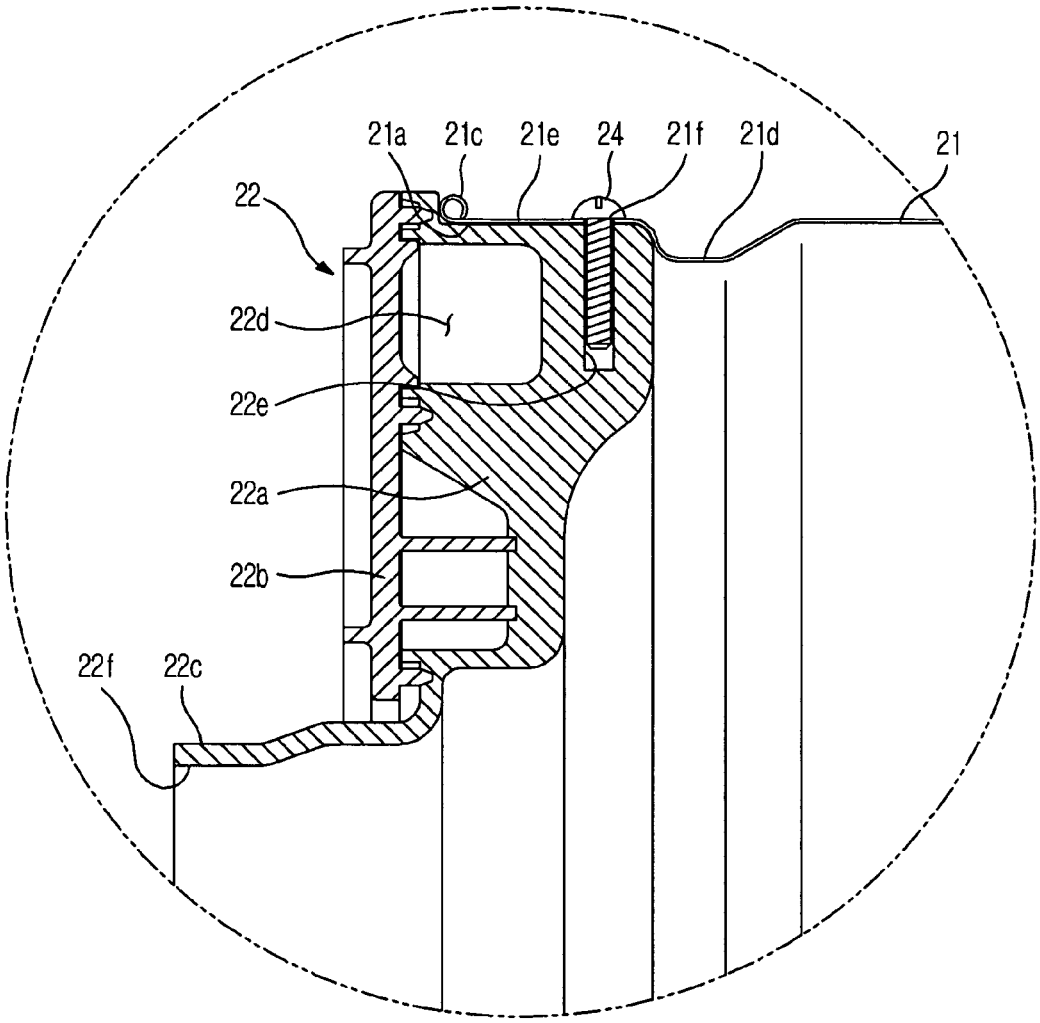
FIG. 4 is an enlarged view illustrating a portion A of FIG. 2.

FIG. 2 is a view illustrating a connection state of the drum to the drum washing machine in accordance with the embodiment, FIG. 3 is a view illustrating a disconnection state of the drum from the drum washing machine in accordance with the embodiment, and FIG. 4 is an enlarged view illustrating a portion A of FIG. 2.

As shown in FIGS. 1 to 4, the drum 20 includes a drum body 21, a balance ring 22 connected to the front portion of the drum body 21, and a back cover 23 connected to the rear portion of the drum body 21.

The drum body 21 may be made of stainless steel. Further, the drum body 21 may be formed in a cylindrical shape through pressing and seaming.

The drum body 21 includes a curling part 21*c* and a neck part 21*d*. The drum body 21 further includes an even part 21*e* between the curling part 21*c* and the neck part 21*d*. The curling part 21*c* and the neck part 21*d* reinforces strength of the drum body 21, and maintain high roundness of the drum body 21. Here, roundness represents a degree to which the machined drum body 21 is close to an ideal circle.

The curling part 21*c* is formed by curling the front end of the drum main body 21 outwardly along the circumference of the drum body 21. The curling part 21*c* of the drum body 21 reinforces strength of the drum body 21, and thus prevents deformation of the drum body 21 although the drum body 21 is rotated at a high speed.

The neck part 21*d* is formed by bending a portion of the drum body 21 separated from the curling part 21*c* inwardly along the circumference of the drum body 21. The neck part 21*d* also reinforces strength of the drum body 21, and thus prevents deformation of the drum body 21 although the drum body 21 is rotated at a high speed.

The even part 21*e* is formed between the curling part 21*c* and the neck part 21*d*. The even part 21*e* represents an even plane formed in the axial direction of the drum body 21. Through the even shape of the even part 21*e*, the balance ring 22 is fitted into or is separated from the drum body 21 without interference with the even part 21*e*.

The balance ring 22 may be made of synthetic resin. The balance ring 22 may be formed in a ring shape by injection molding. The ring-shaped balance ring 22 made of synthetic resin is installed on the cylindrical drum body 21 made of stainless steel. The strength of the drum body 21 lowered by the balance ring 22 made of synthetic resin may be reinforced by the curling part 21*c* and the neck part 21*d* of the drum body 21. Further, the balance ring 22 made of synthetic resin has a low unit cost compared with stainless steel, and freely embodies a shape.

The balance ring 22 may be detachably connected to the drum body 21 through a screw-connection structure between the balance ring 22 and the drum body 21.

When the balance ring 22 passes through a front opening 21*a* formed through the front surface of the drum body 21, an upper support part 22*g* of the balance ring 22 is seated on the curling part 21*c* of the drum body 21, and a lower support part 22*h* of the balance ring 22 is seated on the neck part 21*d* of the drum body 21.

When the balance ring 22 is seated on the drum body 21 by the curling part 21*c* and the neck part 21*d*, the outer circumferential surface of the balance ring 22 and the even part 21*e* face each other. Screw holes 21*f*, into which screws 24 are respectively inserted, are formed through the even part 21*e* of the drum body 21, and screw connection holes 22*e*, to which the screws 24 are respectively connected, are formed on the balance ring 22. Plural screw holes 21*f* may be formed along the circumference of the drum body 21, plural screw connection holes 22*e* may be formed along the circumference of the balance ring 22, and plural screws 24 may be formed corresponding to the plural screw holes 21*f* and the plural screw connection holes 22*e*.

When the balance ring 22 passes through the front opening 21*a* of the drum body 21 and is seated on the drum body 21 through the above structure, the screw connection holes 22*e* of the balance ring 22 are aligned with the screw holes 21*f* of the drum body 21, the screws 24 pass through the screw holes 21*f* from the outside of the drum body 21 and then are connected to the screw connection holes 22*e*. On the contrary, when the screws 24 are released from the screw connection holes 22*e*, the balance ring 22 may be separated from the drum body 21.

Consequently, the balance ring 22 is detachably connected to the drum body 21 by the screw connection structure. Therefore, if the balance ring 22 is replaced with a new one due to a defect of the balance ring 22, the balance ring 22 may be easily separated from the drum body 21 and then a new balance ring 22 may be connected to the drum body 21.

The balance ring 22 further includes a balance body 22*a*, a balance cover 22*b* provided with a ball insertion groove 22*d* and connected to the balance body 22*a*, and a balance rib 22*c* extended from the balance member 22*a* and forming a laundry inlet 22*f*.

The balance cover 22*b* and the balance body 22*a* may be connected by welding. A plurality of balls (not shown) is inserted into the ball insertion groove 22*d* formed by the balance cover 22*b* and the balance body 22*a*. The plural balls inserted into the ball insertion groove 22*d* interact with laundry in the drum 20, and thus maintain balance of the drum 20 during rotation of the drum 20. The drum 20, the balance of which is maintained by the ball balancer 22, may be rotated at a high speed.

The balance rib 22*c* is extended from the inner circumferential surface of the balance body 22*a*. The laundry inlet 22*f* is formed by the balance rib 22*c*, and a user puts or takes laundry into or out of the drum 20 through the laundry inlet 22*f*. Since the balance ring 22 including the balance rib 22*c* is made of synthetic resin, the user may be protected from burn when the user puts or takes laundry into or out of the drum 20.

The back cover 23 may be made of stainless steel. The back cover 23 made of stainless steel may be formed in a circular shape by pressing.

The back cover 23 is installed at a rear opening 21*b* formed through the rear surface of the drum body 21, and is connected to the drum body 23 by seaming.

The back cover 23 and the drum body 21 are made of stainless steel, and thus secure a sufficient strength of the drum 20. However, although the sufficient strength of the drum 20 is secured, a separate reinforcing structure may be employed so as to additionally reinforce the strength of the drum 20.

Hereinafter, with reference to the accompanying drawings, an operation of the drum washing machine in accordance with the embodiment will be described in detail.

A user opens the door 11, and then puts laundry into the drum 29. Thereafter, the user closes the door 11, and then selects proper washing course and washing time.

When the washing course and the washing time are selected, wash water is supplied to the tub 13 through the water supply device 40. At this time, a detergent stored in the detergent box 42 together with the wash water is supplied to the tub 13.

Thereafter, the drum washing machine sequentially performs the wash cycle, the rinse cycle, and the spin cycle.

Particularly, in the rinse cycle or the spin cycle, the wash water stored in the tub 13 is discharged to the outside of the drum washing machine through the drain device 50.

Further, when the drum 20 is rotated at a high speed in the rinse cycle or the spin cycle, the balance of the drum 20 is maintained by the balance ring 22, and thus the drum 20 may be stably rotated at a high speed. Further, the curling part 21*c* and the neck part 21*d* formed on the drum 20 reinforce the strength of the drum 20, and thus prevent deformation of the drum 20 although the drum 20 is rotated at a high speed.

Thereafter, hot air and steam may be supplied to the drum 20 of the drum washing machine by the hot air supply device 60 and the steam supply device 70. The laundry may be rapidly dried by the hot air supplied from the hot air supply device 60, and may be prevented from wrinkling by the steam supplied from the steam supply device 70.

Thereafter, the user opens the door 11, and then takes the laundry out of the drum 20. Here, the balance ring 22 is made of synthetic resin, and thus protects the user from burn while taking the laundry out of the drum 20.

Thereafter, the drum washing machine completes washing of the laundry simultaneously with elapse of the predetermined washing time, and then the operation of the drum washing machine is stopped.

As is apparent from the above description, a drum washing machine in accordance with an embodiment allows a balance ring to be replaced with a new one when the balance ring is defective.

Further, the drum washing machine in accordance with the embodiment employs a drum made of synthetic resin and thus reduces loss of resin to reduce production costs, and allows the drum to have various shapes of the front surface thereof.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A drum washing machine comprising a housing, a tub and a motor to rotate a drum supported by the tub, the drum comprising:

a drum body provided with at least one opening; and a balance ring passing through the at least one opening and detachably connected to the drum body and including a ball insertion groove to accommodate a plurality of balls;

wherein the drum body includes a curling part formed at an end of the drum body in the outward direction of the drum body along the circumference of the drum body, wherein the drum body includes a neck part that is a portion of the drum body separated from an end of the drum body and that is bent in the inward direction of the drum body along the circumference of the drum body, and the balance ring includes a lower support part fitted into the drum body and seated on the neck part and an upper support part protruded from an outer circumference of the balancing ring in an outward direction, wherein the circumference of the drum body and a circumference of the balance ring between the curling part and the neck part are formed on a common, even plane, which formed in a axial direction of the drum body, and wherein the upper support part directly contacts with a front of the curling part.

2. The drum washing machine according to claim 1, wherein the drum body and the balance ring are screw-connected to each other.

3. The drum washing machine according to claim 1, wherein the drum body is made of stainless steel, and the balance ring is made of synthetic resin.

4. The drum washing machine according to claim 1, wherein the drum body is formed in a cylindrical shape, and the balance ring is formed in a ring shape.

5. The drum washing machine according to claim 1, wherein the balance ring includes a balance rib forming a laundry inlet, through which laundry is put into the drum.

6. A drum, rotatably supported by a tub, comprising:

a drum body provided with at least one opening; and a balance ring passing through the at least one opening and detachably connected to the drum body and including a ball insertion groove to accommodate a plurality of balls;

wherein the drum body includes a curling part formed at an end of the drum body in the outward direction of the drum body along the circumference of the drum body, wherein the drum body includes a neck part that is a portion of the drum body separated from an end of the drum body and that is bent in the inward direction of the drum body along the circumference of the drum body, and the balance ring includes a lower support part fitted into the drum body and seated on the neck part and an upper support part protruded from an outer circumference of the balancing ring in an outward direction, wherein the circumference of the drum body and a circumference of the balance ring between the curling part and the neck part are formed on a common, even plane, which formed in a axial direction of the drum body, and wherein the upper support part directly contacts with a front of the curling part.

7. The drum according to claim 6, wherein the drum body and the balance ring are screw-connected to each other.

8. The drum according to claim 6, wherein the drum body is made of stainless steel, and the balance ring is made of synthetic resin.

* * * * *

UNITED STATES PATENT AND TRADEMARK OFFICE

CERTIFICATE OF CORRECTION

PATENT NO. : 9,091,013 B2
APPLICATION NO. : 12/926163
DATED : July 28, 2015
INVENTOR(S) : Kim et al.

It is certified that error appears in the above-identified patent and that said Letters Patent is hereby corrected as shown below:

In the claims

Claim 1, Column 7, Line 11

Delete “body,” and insert --body--, therefor.

Claim 6, Column 8, Line 12

Delete “body,” and insert --body--, therefor.

Signed and Sealed this
Eighth Day of December, 2015

Michelle K. Lee

Michelle K. Lee
*Director of the United States Patent and Trademark Office*